US005631675A

United States Patent [19]

Futagawa

[11] Patent Number: 5,631,675

[45] Date of Patent: May 20, 1997

[54] METHOD AND APPARATUS FOR DRIVING AN INK JET RECORDING HEAD

[75] Inventor: Yoshikiyo Futagawa, Nagano, Japan

[73] Assignee: Seiko Epson Corporation, Tokyo, Japan

[21] Appl. No.: 318,340

[22] Filed: Oct. 5, 1994

[30] Foreign Application Priority Data

Oct. 5, 1993 [JP] Japan ..... 5-249576
Jun. 2, 1994 [JP] Japan ..... 6-121475

[51] Int. Cl.[6] ..... B41J 29/38; B41J 2/01

[52] U.S. Cl. ..... 347/10; 347/68

[58] Field of Search ..... 347/9, 10, 11, 347/14, 68; 358/296, 298; 307/52; 363/26, 197

[56] References Cited

U.S. PATENT DOCUMENTS 5,426,454 6/1995 Hosono et al. ..... 347/9

*Primary Examiner*—Benjamin R. Fuller
*Assistant Examiner*—L. Anderson
*Attorney, Agent, or Firm*—Sughrue, Mion, Zinn, Macpeak & Seas

[57] ABSTRACT

A method and apparatus for driving piezoelectric units of an ink jet recording head to control the ink jet recording head to jet ink droplets having uniform sizes and at uniform jetting velocity, without being influenced by any change in the temperature of the surrounding environment. In one embodiment, two constant current sources are employed provide driving voltages which charge and discharge a capacitor, and the voltage of the capacitor is amplified to provide the voltage for driving the piezoelectric units. In another embodiment, a digital output from a counter, having a clock frequency controlled in accordance with the temperature of the environment, is converted into an analog voltage signal rising or falling in stages. This analog voltage signal is amplified to provide a driving voltage for driving the piezoelectric units.

15 Claims, 14 Drawing Sheets

METHOD AND APPARATUS FOR DRIVING AN INK JET RECORDING HEAD

BACKGROUND OF THE INVENTION

1. Field of the Invention

The present invention relates to a method and apparatus for driving an ink jet recording head having piezoelectric units and, in particular, a method and apparatus for driving an ink jet recording head to provide uniform ink jetting characteristics of the ink jet recording head without being influenced by fluctuations in temperature of the surrounding environment.

2. Description of the Related Art

FIGS. 1(*a*) and 1(*b*) illustrate a conventional on-demand type ink jet recording head for an ink jet printer. In particular, FIG. 1(*a*) is a sectional view of an actuator of the ink jet recording head, and FIG. 1(*b*) illustrates an electrical equivalent circuit for the same.

An ink chamber 2 of the actuator is formed of an ink chamber frame 1 and a vibrating plate 4, and a piezoelectric unit 5, which expands and contracts as controlled by an electric field applied thereto, is rigidly mounted on the vibrating plate 4. The volumetric capacity of the ink chamber 2 is expanded or contracted as the vibrating plate 4 is displaced by operation of the piezoelectric unit 5.

To impose an electric field on the piezoelectric unit 5, an electric voltage is applied from an outside power source via driving line 7 to an electrode 6 which is disposed on the piezoelectric unit 5. This applied voltage causes a distortion in the piezoelectric unit 5, and this distorting force causes the vibrating plate 4 to exert an abrupt pressing force on the ink chamber 2, thereby jetting forth ink droplets 3 out of very small holes present in the ink chamber frame 1. A plurality of actuators such as this are disposed in the an ink jet recording head.

The piezoelectric unit 5 can be represented in electrical terms as a capacitor, as shown in FIG. 1(*b*). Accordingly, electric current in proportion to the time differential of the waveform of the applied voltage flows as a charging current and a discharging current when the electric field is applied and removed, respectively.

As the voltage is applied to and removed from the piezoelectric unit 5 at a higher frequency, the charging current and the discharging current increases. Hence, when a large number of driving elements are present in the piezoelectric unit 5, for example, when 24 elements are driven, the charging or discharging current will have a peak value of 50A. Consequently, a large drop in the voltage on the driving line 7 occurs. This results in a considerable change in the jetting characteristics effected by the driving elements in the piezoelectric unit 5, and also a breakdown of electronic components in the piezoelectric unit 5.

Therefore, in an attempt to eliminate these problems, a method for driving a piezoelectric unit exists in which the charging and discharging currents are limited by current limiting resistors. This method is described in U.S. Pat. Nos. 4,459,599, 4,126,867, and 4,282,535.

In this method, however, the resistance values of the current limiting resistors are readily susceptible to change. As a result, the charging and discharging times for the individual piezoelectric units vary, which affects the ink jetting characteristics considerably. This problem also exists in integrated circuit (IC) including such current limiting resistors.

Moreover, the charging and discharging times of the piezoelectric units will eventually become different due to inherent changes in capacitance of the individual piezoelectric units. Hence, because of this, the ink jetting characteristics will deteriorate even if current limiting resistors having identical resistances could formed in an IC with a high degree of accuracy.

As an alternative, U.S. Pat. No. 4,284,996 describes a method for driving one piezoelectric unit with constant current sources, one of which being a flow type and the other being a synchronizing type. However, in this method, it is difficult to maintain uniform driving characteristics when driving a plurality of piezoelectric units due to the differences in the capacitances of the piezoelectric units and the differences in the current values of the constant current sources.

In an attempt to eliminate the problems associated with the conventional apparatuses, such as those described above, applicant has previously developed a driving device which is capable of suppressing the peak values of the charging and discharging currents without being influenced by the differences in the capacitance of the piezoelectric units, and without using any current limiting resistors. In particular, in the driving device, a plurality of piezoelectric units are directly coupled to a driving power source whose output voltage is fluctuated at a prescribed gradient in a single driving period for the piezoelectric units. This device is described in Japanese Laid Open Patent Application Nos. 274554-1990 (Heisei 2), 36036-1991 (Heisei 3), 133647-1991 (Heisei 3), 164544-1990 (Heisei 2), 369543-1992 (Heisei 4).

FIGS. 2(*a*) and 2(*b*) of the present application illustrate this driving device. A high voltage Vp of approximately 20 V is input to the driving voltage generator 10 and 20, while a Vd of approximately 5 V is input to power the logic circuit. The driving voltage generators 10 and 20 are grounded at GND, and output a driving voltage Vs for driving the piezoelectric units 14. In subsequent figures, identical parts are identified by the same numbers or characters.

The driving circuit of FIG. 2(*a*) is employed in an ink jet recording head which uses d31 type piezoelectric units and has pressure chambers which expand upon application of a voltage to the piezoelectric units, thereby sucking ink out of the reservoir and the pressure chamber upon removal of the voltage and thus jetting out ink droplets. In this driving circuit, the individual piezoelectric units 14 of the piezoelectric unit array 13 are connected, via bi-directional transfer gates 12 acting as selecting switches in a block of selecting switches 11, to the output of a driving voltage generator 10, which generates the driving voltage Vs that changes at a desired gradient. Because the electric power is applied selectively to these transfer gates 12 to charge and discharge the piezoelectric units 14 which are made of the same base material, the driving voltage Vs at the prescribed voltage gradient is applied selectively to the piezoelectric units 14 without being influenced by any dispersion in their capacitance.

FIG. 2(*b*) illustrates a driving circuit which is employed in an ink jet recording head which uses d33 type piezoelectric units and has pressure chambers which expand upon application of a voltage to the piezoelectric units, thereby sucking ink out of the reservoir and the pressure chamber upon removal of the voltage and thus jetting out ink droplets. The driving voltage generator 20 generates a negative driving voltage −Vs which changes at a desired gradient.

In this driving circuit, a common terminal of the piezoelectric units 14 of the piezoelectric unit array 13 is connected to the output of driving voltage generator 20 which generates the driving voltage –Vs that changes at the desired gradient. The other ends of the piezoelectric units 14 are connected to ground GND via a group of selecting switches 21 comprising mono-directional transistors 22, each having a parasitic diode 23 coupled in parallel. These selecting switches can be formed in an IC, such as those presently sold on the market.

When the driving voltage –Vs grows larger at a constant gradient in the negative direction, all the piezoelectric units 14 are charged via the parasitic diodes 23, and the pressure chamber is thereby expanded. Then, as the driving voltage Vs becomes smaller (i.e., is reduced toward zero) at a prescribed gradient, electric power is conducted through only transistors 22, which have a signal being applied to their bases sufficient to turn on the transistors. Hence, the piezoelectric units 14 corresponding to those transistors 22 are discharged, which causes the corresponding pressure chambers to contract, thereby jetting out the ink. Moreover, the transistors 22 having an "off" signal (i.e. a voltage not large enough to turn on the transistor) applied to their bases remain non-conductive, and thus, the piezoelectric units 14 coupled to these transistors maintain their charged state, and do not jet out any ink.

FIG. 3(*a*) illustrates an arrangement of the circuit of the driving voltage generator 10, which generates a driving voltage Vs, as shown in FIG. 2(*a*). This driving voltage generator 10 charges a capacitor C via a transistor TR1 at a time constant determined by the capacitance of capacitor C and the resistance of resistor Rt1, and thereafter discharges the capacitor C via a transistor TR2 at a time constant determined by the capacitance of capacitor C and the resistance of resistor Rt2, thereby obtaining a reference fluctuating voltage. The driving voltage Vs is generated by amplifying this fluctuating voltage of the capacitor C by a power amplifier 30. This power amplifier 30 comprises a pair of mutually complementary transistors.

This circuit illustrated in FIG. 3(*a*) is simple and low cost. However, since the waveform has the characteristics of an exponential function, the waveform tapers near the end of operation of the actuator. Hence, this driving device cannot attain favorable ink jetting characteristics. Moreover, the charging and discharging currents of the piezoelectric unit, respectively, have the characteristics of an exponential function and thus do not provide constant current. Accordingly, in this circuit, large current flows in the initial phases of the charging period and discharging period, which is not favorable.

FIG. 3(*b*) illustrates a driving voltage generator which overcomes the defects of the conventional driving devices described above. This driving device attains a reference fluctuating voltage by charging and discharging the capacitor C with constant current sources 31 and 32. The reference fluctuating voltage is amplified by the power amplifier 30, and the driving voltage Vs is thereby obtained.

The piezoelectric units are thus driven with constant charging and discharging currents at the driving voltage Vs. When this process is used, the voltage Vc of the capacitor C will be $Vc=(i1/C)\times t$ or $Vc=Vp-(i2/C)\times t$ (wherein, t: time). The voltage Vc, therefore, undergoes a linear change, and thus, this voltage generator overcomes the problems found with the conventional driving voltage generators.

FIGS. 4(*a*) through 4(*c*) illustrate the wave-forms provided by the driving voltage generator, which attains a linear change in the generated voltage, as shown in FIG. 3(*b*). In particular, FIGS. 4(*a*) and 4(*b*) show the wave-form of the driving voltage Vs that is provided, and FIG. 4(*c*) shows the wave-form of the driving current Is that is provided. Actually, FIGS. 4(*a*) and 4(*b*) show the driving voltage Vs that it is used for the d31 type piezoelectric units and the d33 type piezoelectric units, respectively.

Differences in the base material of which a piezoelectric unit is made, such as a difference in the thickness of the base material, will result in a difference in the amount of expansion or contraction of the piezoelectric unit, so that there will be differences in the quantity of the jetted ink, the velocity of the jetted ink, and so forth. Accordingly, it is necessary to adjust the value of the wave height of the driving voltage Vs in order to compensate for such differences.

Furthermore, it is necessary to adjust the value of the wave height of the driving voltage when there is a sharp change in the characteristics (e.g. viscosity) of the ink in relation to the temperature in the environment. Such a correction can be made by adjusting the charging and discharging times of the piezoelectric unit, as shown by a single dot chain line in FIGS. 4(*a*) and 4(*b*). However, such an adjustment increases the time in which the ink chamber is maintained in its state of its maximum expansion from t0 to t0'. As a result, a deviation occurs in the position of the meniscus of the ink at the point in time when the ink is jetted out, and thus, a change eventually occurs in the ink jetting characteristics.

Also, with the driving voltage generator shown in FIG. 3(*b*), the charging current i1, which is fed from the constant current source 31 to the capacitor C, and the discharging current i2, fed from the constant current source 32, will assume the values determined by the following equations:

$$i1=Ebe/Rs2$$

$$i2=Ebe/Rs4$$

where the voltage between the base and emitter in transistors TR3 and TR6 is expressed as Ebe.

However, the voltage between the base and emitter of a transistor depends on the temperature in the environment and changes considerably from 0.7 V to 0.35 V in the range from 0° to 40° C. Hence, the circuit shown in FIG. 3(*b*) suffers from problems related to the temperature characteristics.

SUMMARY OF THE INVENTION

Accordingly, in view of the problems associated with the conventional driving devices, as described above, it is an object of the present invention to provide a driving device for use with an ink jet recording head that is capable of maintaining consistent ink jetting characteristics by adjusting the value of the wave height of the driving voltage wave-form while controlling the rise and fall times of the driving voltage wave-form to fluctuate consistently at a desired voltage gradient. It is further an object of the present invention to provide a driving device which is not influenced by temperature.

To achieve the above objects, a driving device of the present invention, for driving an ink jet recording head, includes a driving voltage generator which generates a driving voltage waveform rising and/or falling in a prescribed driving period to drive a plurality of piezoelectric units. The force generated by the piezoelectric units when driven enlarges or reduces the volumetric capacity of an ink chamber of the ink jet recording head, thereby jetting out ink droplets through nozzle holes formed in the recording head.

The driving voltage generator such as this comprises a constant voltage source, which is capable of varying the output voltage in accordance with a correcting voltage signal, and a first constant current source, which generates a first constant voltage in proportion to the output voltage through the use of the constant voltage source.

The driving voltage generator further includes a capacitor, which is charged approximately up to the output voltage by the first constant current, and a second constant current source, which provides a second constant current, in proportion to the output voltage, for discharging the charged capacitor. Finally, the driving voltage generator comprises a power amplifier, which inputs the voltage of the capacitor and outputs the driving voltage wave-form approximately equal to the terminal voltage of the capacitor. Accordingly, the driving device of the present invention keeps the rise and fall times of the driving voltage wave-form constant, regardless of the correcting voltage signal.

The driving device of the present invention is also capable of varying the wave height of the driving voltage waveform by adjusting of the correcting voltage signal in accordance with the temperature of the environment. Further, the constant current sources which generate the first and second constant currents each comprise a pre-transistor, which acts as an emitter or source follower to receive a voltage in proportion to the output voltage, an output transistor, connected at its base or gate to the emitter or source of the pre-transistor, and a resistor for setting a value of the electric current at the emitter of the output transistor.

The driving device of the present invention also includes a device for detecting the point in time when the driving voltage waveform attains its maximum voltage or minimum voltage, and a phase difference detecting device which detects a deviation in phase between the output from the detecting device and a reference signal indicating the point in time. The driving device further includes a device for making fine adjustments of the first constant current or the second constant current in accordance with the output from the phase difference detecting device regardless of the output voltage from the constant voltage source. The driving device therefor automatically adjusts the rise or fall times of the driving voltage waveform to a set value.

Accordingly, in the driving device of the present invention as described above, the capacitor is charged up to the output voltage value of a variable constant voltage source by using a constant current source. In the constant current source, the current value is controlled by a voltage dividing signal for the output from the variable constant voltage source, and then the capacitor is discharged until it attains a zero voltage potential. Hence, the capacitor thereby produces a reference voltage and the driving voltage generator generates a driving voltage Vs on the basis of this reference voltage. Thus, simply by adjusting the output from the variable constant voltage source in accordance with the temperature in the environment in such a manner as to correct characteristics of the ink such as viscosity or the like, it is possible to vary the value of the wave height of the driving voltage Vs while maintaining the rise and fall times of the driving voltage Vs constant.

Furthermore, the constant current source formed of mutually complementary transistors, namely, a pair of a PNP transistor and an NPN transistor in a cascade connection, cancels the respective base-emitter voltage components, so that the constant current source itself does not depend on temperature.

The present invention also provides another driving device, for driving an ink jet recording head, which includes a driving voltage generator for generating a driving voltage waveform rising and/or falling in a prescribed driving period to drive a plurality of piezoelectric units disposed in the ink jet recording head. The force generated by the piezoelectric units being driven enlarges or reduces the volumetric capacity of an ink chamber, thereby jetting out ink droplets through nozzle holes in the recording head.

The driving voltage generator comprises a device for generating a variable frequency clock signal, a counter which counts the clock signal, and a control device which outputs an adding signal, a counting stop signal, and a deducting signal in repetition at prescribed time intervals to the counter. The driving voltage generator further includes a digital-analog (D/A) converter, which converts the digital output from the counter into an analog voltage, a voltage amplifier for amplifying the analog voltage, and a power amplifier which inputs the output voltage from the voltage amplifier and outputs the driving voltage waveform approximately equal to the output voltage from the voltage amplifier. Hence, this driving device of the present invention keeps the rise and fall times of the driving voltage waveform constant, regardless of the frequency of the clock signal.

This driving device also is capable of varying the wave height of the driving voltage waveform by adjusting the frequency of the clock signal in accordance with the temperature of the environment.

Accordingly, in the second driving device provided by the present invention, the count output from a counter which counts the clock signals at prescribed time intervals is converted by a digital-to-analog (D/A) converter into analog voltage signals which rise or fall in stages. These analog voltage signals are amplified to produce a reference voltage, and a driving voltage Vs for the piezoelectric unit is generated on the basis of this reference voltage. Therefore, no capacitor, whose capacitance may change due to a change in temperature or a secular change, is necessary. Hence, a more stable driving voltage Vs can be obtained.

Further, the second driving device is capable of varying the wave height value of the driving voltage waveform, while keeping the rise and fall times of the driving voltage Vs constant simply by adjusting the frequency of the clock signal in accordance with the temperature in the environment, so as to correct the viscosity characteristics, etc., of the ink.

The power amplifier of both driving devices described above includes a front stage comprising a first transistor and a second transistor whose bases and emitters are connected to each other, and which are mutually complementary and perform a push-pull operation on the voltage at their base terminals. An output stage of the power amplifier comprises a third transistor circuit, which is substantially complementary with the first transistor, and a fourth transistor circuit, which is substantially complementary with the second transistor. The collector and emitter of the first transistor is connected to the base and emitter of the third output transistor circuit, so that the collector current generated by the first transistor is applied as the base current of the third transistor circuit. Further, the collector and emitter of the second transistor is connected to the base and emitter of the fourth output transistor circuit, so that the collector current generated by the second transistor is applied as the base current of the fourth transistor circuit.

Both of the driving devices described above comprise a current limiting circuit which inhibits base current flowing to the third transistor circuit and the fourth transistor circuit, respectively, when an output current flowing through the third transistor circuit and the fourth transistor circuit, respectively, flows in excess of a predetermined value.

BRIEF DESCRIPTION OF THE DRAWINGS

These and other objects and advantages of the invention will become more apparent and more readily appreciated from the following detailed description of the presently preferred exemplary embodiments of the invention taken in conjunction with the accompanying drawings, of which:

FIG. 1(*b*) shows an equivalent electronic circuit for the ink jet recording head shown in FIG. 1(*a*);

FIG. 4(*c*) is a graph illustrating the current waveform Is generated by the conventional driving voltage generators shown in FIGS. 3(*a*) and 3(*b*);

FIG. 8(*c*) illustrates waveforms of the charging and discharging currents applied to the capacitor in the circuit of FIG. 5;

FIG. 8(*d*) illustrates the voltage of the capacitor C in the circuit shown in FIG. 5;

FIG. 9(*c*) is another illustration of waveforms of charging and discharging currents applied to the capacitor in the circuit of FIG. 5;

FIG. 9(*d*) is another illustration of the voltage of the capacitor C in the circuit shown in FIG. 5;

FIG. 12(*b*) is a graph illustrating the signal Ts which indicates the starting point in time for the rise-up of the driving voltage shown in FIG. 12(*a*);

FIG. 12(*c*) is a graph of the reference signal Td which indicates the target point in time for the termination of the rise-up of the driving voltage shown in FIG. 12(*a*);

FIG. 12(*d*) is a graph of an output signal from a peak detector of the circuit shown in FIG. 11;

FIGS. 12(*e*) is a graph illustrating an advance phase signal provided by a phase detector in the circuit shown in FIG. 11;

FIG. 12(*f*) is a graph showing a delay phase signal provided by the phase detector in the circuit shown in FIG. 11;

FIG. 13(*b*) is a graph illustrating a waveform of the driving voltage generated by the circuit shown in FIG. 13(*a*);

DETAILED DESCRIPTION OF THE PREFERRED EMBODIMENTS

Figure 5:
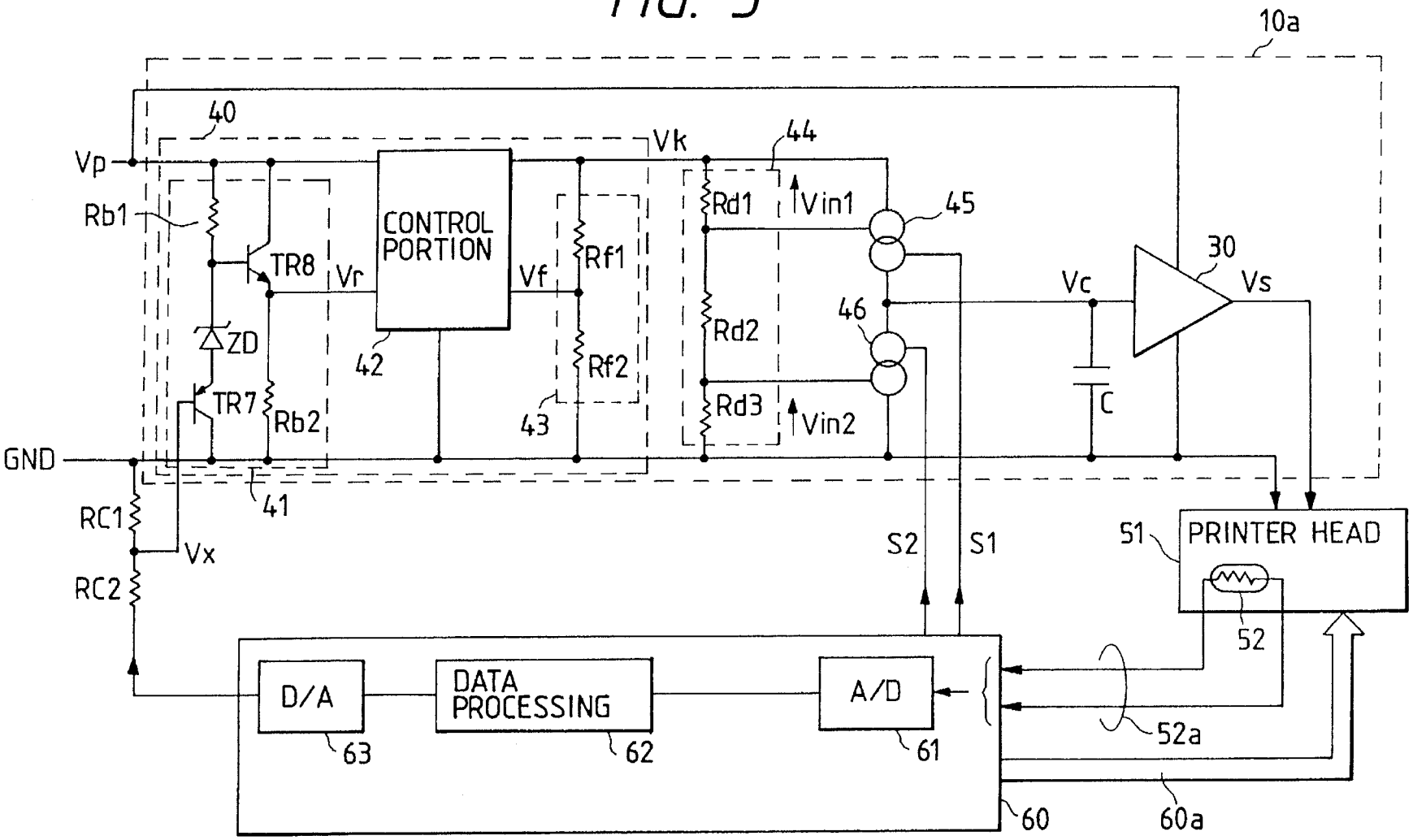
FIG. 5 shows a circuit diagram of an embodiment of a driving device of the present invention for use in an ink jet recording head.

FIG. 5 is a circuit diagram showing an embodiment of a driving device, for use with an ink jet recording head, provided by the present invention. As shown, a driving voltage generator 10*a* includes a variable constant voltage source 40 for outputting a voltage Vk, which is dependent on the temperature of the environment.

The variable constant voltage source 40 comprises a reference voltage generating unit 41, which generates a reference voltage Vr achieved by superposing a correcting voltage Vx, which will be described later, on a Zener voltage of a Zener diode Zd. A feedback unit 43 generates a voltage Vf which is obtained by dividing the output voltage Vk by resistors Rf1 and Rf2. Further, a controller 42 compares the voltage Vr from the reference voltage generating unit 42 to the voltage Vf from the feedback unit 43 to control the output voltage Vk so that Vr is equal to Vf.

A voltage divider 44 of the driving voltage generator 10*a* produces voltage Vin1 and voltage Vin2 by dividing the output voltage Vk from the variable constant voltage source 40 by the resistors Rd1, Rd2, and Rd3. These voltages Vin1 and Vin2 control constant current sources 45 and 46, respectively, to each generate a constant current.

Constant current source 45 generates a constant current in proportion to the voltage Vin1, and a current from this constant current source 45 charges the capacitor C. The rise which occurs in the voltage at the terminal of the capacitor C at such a time is linear, and the charging voltage Vc attains a peak value approximately equal to the output voltage Vk.

Constant current source 46 generates a constant current in proportion to the voltage Vin2, and the capacitor C is discharged by this constant current source 46. The voltage at the terminal of the capacitor C during discharge decreases linearly from the peak voltage Vk to zero. These constant current sources 45 and 46 are operated in accordance with control signals S1 and S2 output alternately in a prescribed operating cycle from a system controller 60.

The voltage Vc at the terminal of the capacitor C is amplified by a power amplifier 30, and a driving voltage Vs for a piezoelectric unit is thereby generated.

Figure 1A:
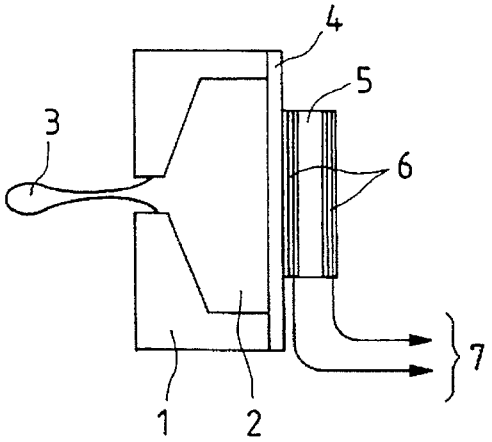
PRIOR ART FIG. 1(a)
FIG. 1(*a*) illustrates a conventional ink jet recording head employing a piezoelectric unit.
Figure 1B:
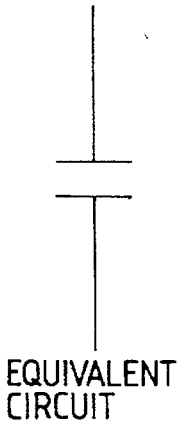
PRIOR ART FIG. 1(b)
Figure 2A:
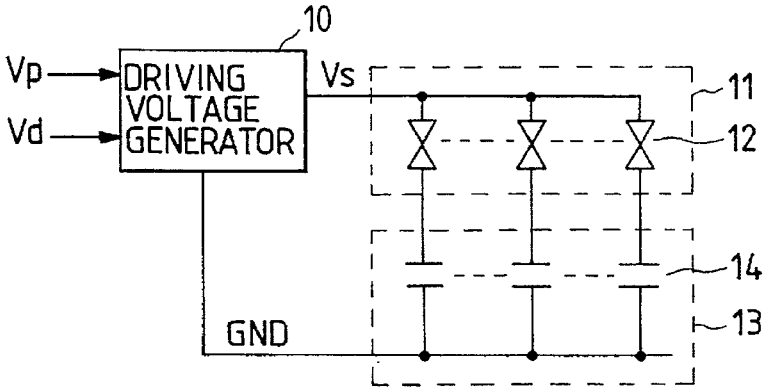
FIG. 2(a) PRIOR ART
FIGS. 2(*a*) and 2(*b*) are circuit diagrams of conventional driving devices for an ink jet recording head shown in FIG. 1(*a*)
Figure 2B:
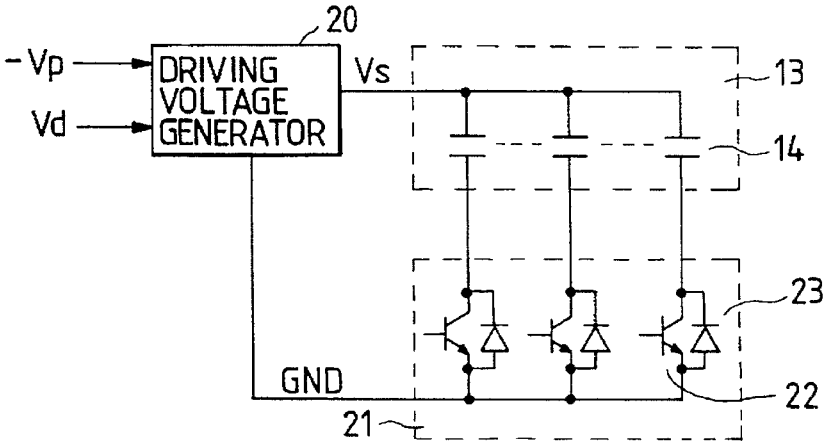
FIG. 2(b) PRIOR ART
Figure 3A:
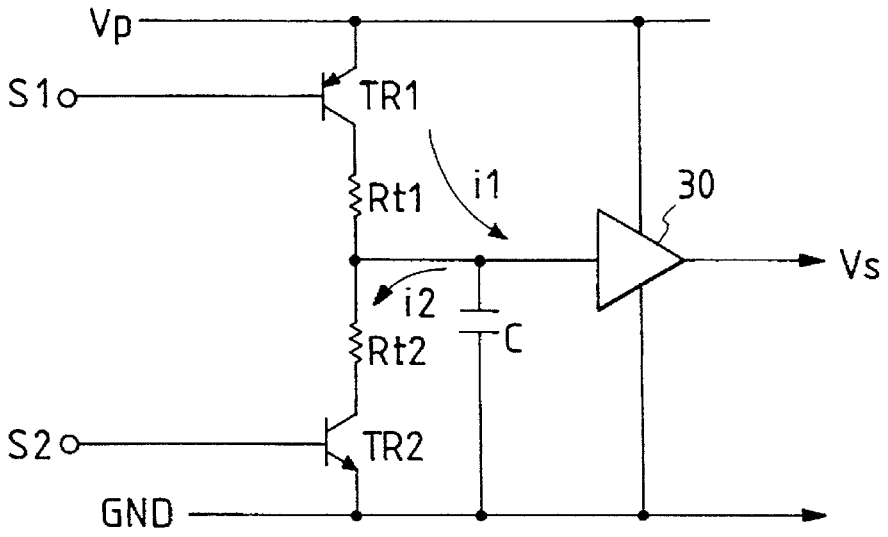
FIG. 3(a) PRIOR ART
FIGS. 3(*a*) and 3(*b*) each illustrate circuit diagrams of typical driving voltage generators employed in the driving devices shown in FIGS. 2(*a*) and 2(*b*)
Figure 3B:
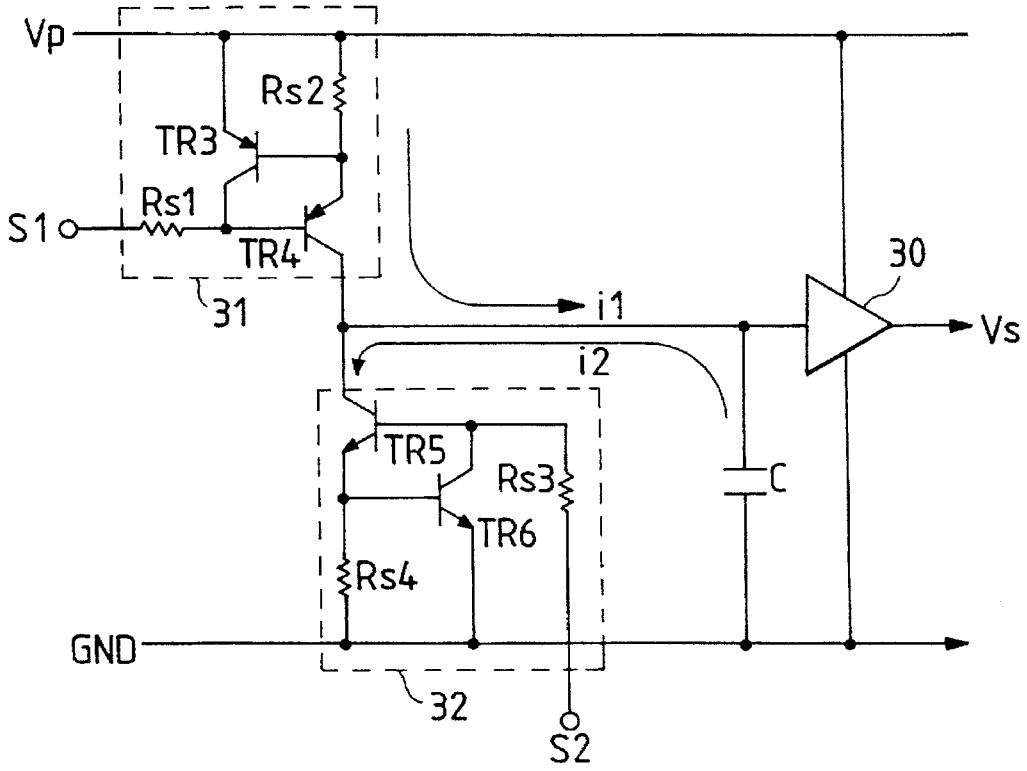
FIG. 3(b) PRIOR ART
Figures 4A, 4B, 4C:
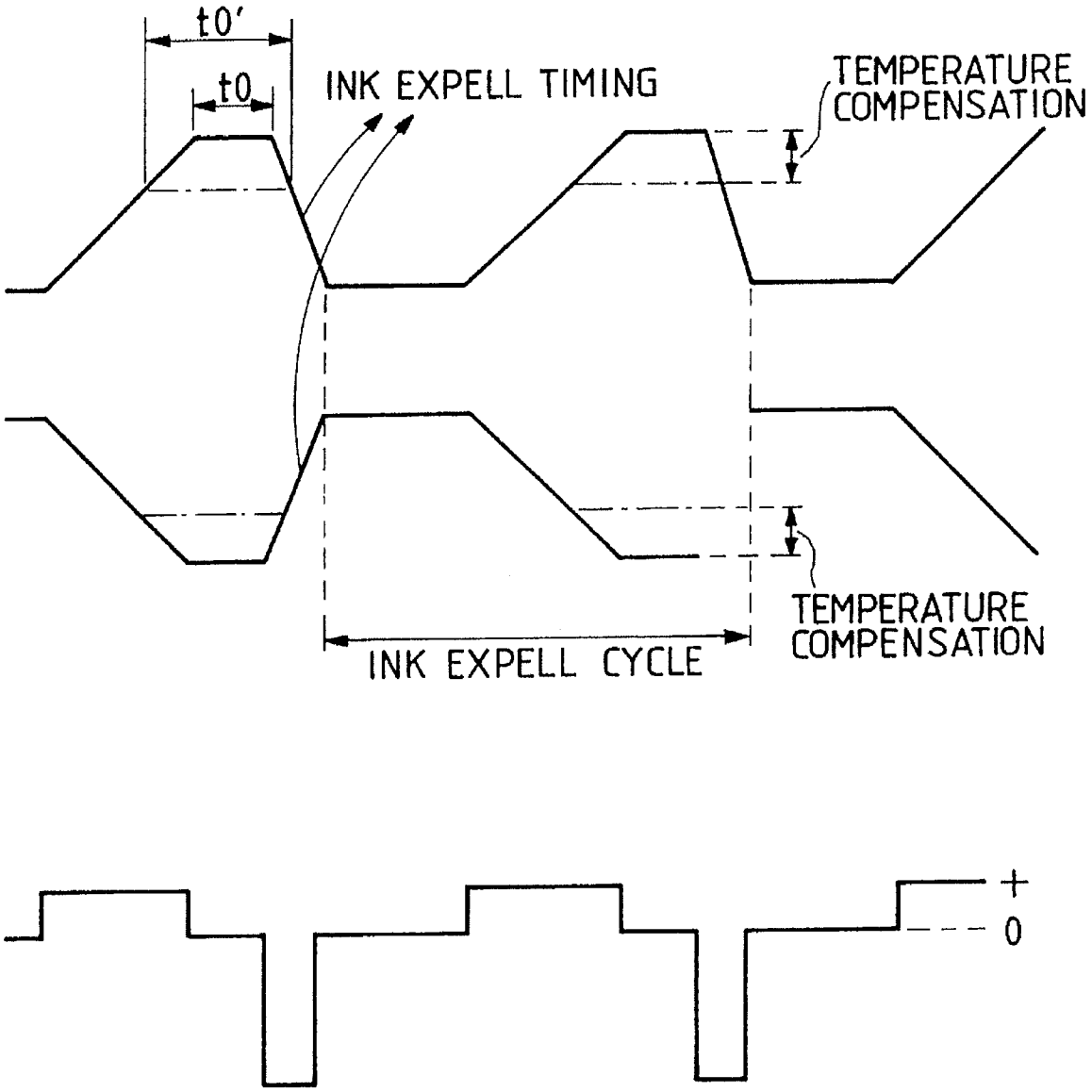
FIG. 4(a) PRIOR ART
FIG. 4(b) PRIOR ART
FIG. 4(c) PRIOR ART
FIGS. 4(*a*) and 4(*b*) are graphs illustrating the voltage waveform of a driving voltage Vs generated by the conventional driving voltage generators shown in FIGS. 3(*a*) and 3(*b*)

Recording head 51 includes an actuator formed of piezoelectric units, a selecting switch unit shown in FIG. 2(*a*) or FIG. 2(*b*), and a temperature sensing element 52 for detecting the temperature of the environment. The temperature information, which is obtained based on changes in the resistance value of the temperature sensing element 52, is input to the system controller 60 via a signal line 52*a*, and the system controller 60 outputs a printing data signal, via a signal line group 60*a*, which controls the selecting switch unit.

The temperature information input to the system controller 60 is converted into a digital value by an analog-digital (A/D) converter 61. The digital value is input to a data processing device 62 comprising a look-up table, and the data processing device 62 outputs compensating data for changing the peak value of the driving voltage Vs in order to compensate for the fluctuations which the temperature causes in the elements of the actuator. This compensating data is converted into analog values by a digital-analog (D/A) converter 63, and the analog values are output to the reference voltage generating unit 41 to cause the reference voltage generating unit 41 to set the reference voltage Vr at a higher level as the temperature decreases. In particular, as described above, the reference voltage Vr is changed by superposing a correcting voltage Vx, which is obtained by dividing the voltage of the analog output from the digital-analog (D/A) converter 63 by resistors Rc1 and Rc2, on a Zener voltage of the Zener diode ZD via transistor TR7.

The reference voltage Vr which is thus generated at resistor Rb2 is expressed by the following equation:

$$Vr=Vx+Ebe7+Vz-Ebe8$$

where the saturated voltage between the base and emitter of the PNP type transistor TR7, and that between the base and emitter of the NPN type transistor TR8, are expressed as Ebe7 and Ebe8, respectively, and the Zener voltage of the Zener diode ZD is expressed as Vz.

However, since Ebe7 and Ebe8 are almost equal, though they change under the influence of the temperature, the terms Ebe7 and Ebe8 cancel each other, and the following equation is obtained:

$$Vr=Vx+Vz$$

Thus, the temperature characteristics of the base-emitter voltages of the transistors do not appear in the reference voltage Vr. That is, the output voltage Vk from the variable constant voltage source 40 can be expressed by the following equation:

$$\begin{aligned} Vk &= Vr\cdot(1+Rf1/Rf2) \\ &= (Vx+Vz)\cdot(1+Rf1/Rf2) \end{aligned}$$

Figure 6:
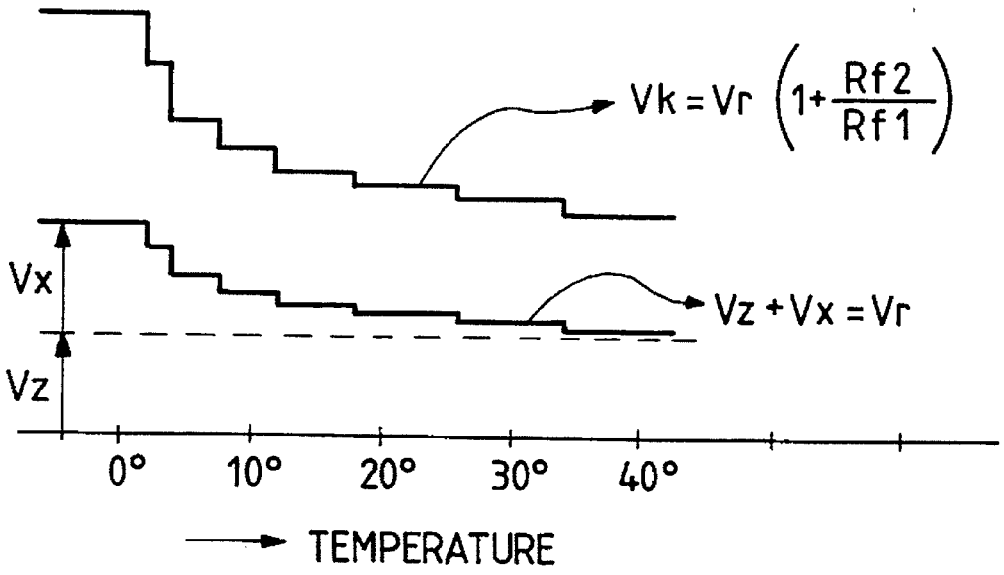
FIG. 6 is a graph illustrating the temperature characteristics of the output voltage of the variable constant voltage source of the circuit shown in FIG. 5.

Hence, the output voltage Vk depends only on a correcting voltage Vx according to the temperature and is therefore adjusted, at a high degree of accuracy, to the voltage value shown in FIG. 6. In this regard, the value of resistor Rb1 is determined to be a value to allow ample electric current to flow so that an adequate Zener voltage Vz can be generated.

It is conceivable that in a temperature correcting method, temperature sensing element 52 can control directly the reference voltage generating unit 41 or the feedback unit 43. However, it is sometimes difficult to select a temperature sensing element 52 that matches the temperature characteristics of the actuator or those of the recording head. In particular, a temperature correcting process in which a temperature sensing element directly operates to correct a driving voltage applied to a piezoelectric unit is disclosed in Laid Open Japanese Patent Application No. 65566-1980 (Showa 55). However, that process is completely different from the present invention, in particular, with regard to circuit construction and the driving system.

When correction needs to be made for the thickness, etc., of the piezoelectric unit, it is necessary to change the value of the wave height in the driving voltage even if the temperature remains the same. To accomplish this, a driving voltage generating unit should be constructed so that the ratio of the resistors Rf1 and Rf2 in the feedback unit 43 can be varied to adjust the feedback voltage Vf.

In the circuit construction shown in FIG. 5, the output which can be obtained from the digital-analog (D/A) converter 63 will be a maximum of approximately 3.33 V, which corresponds to 5 V×⅔ (the details of calculating this value are omitted here for convenience), provided that the voltage supplied to the digital-analog (D/A) converter 63 is 5 V.

However, during actual application, sometimes the variable ratio of the reference voltage Vr needs to be increased. In such a case, the Zener voltage Vz can be reduced. Nevertheless, in this case, in order to obtain a prescribed output voltage Vk, it is necessary to make the magnifying ratio of (1+Rf1/Rf2) larger. Hence, it may not be possible to obtain a favorable output voltage Vk.

Figure 7:
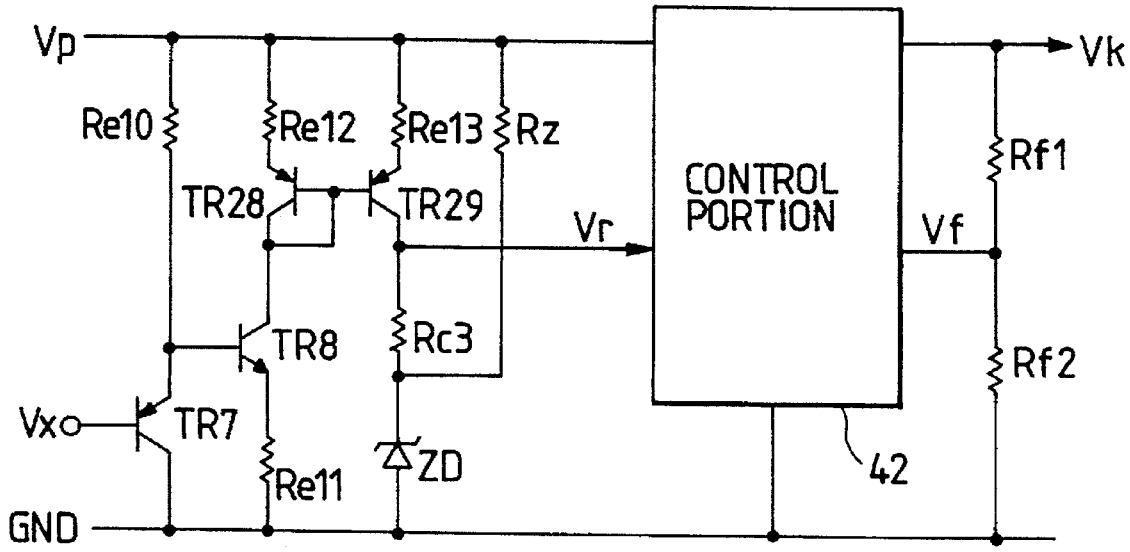
FIG. 7 is a circuit diagram of an embodiment of a variable constant voltage source used in a driving device of the embodiment of the present invention shown in FIG. 5.

To overcome this dilemma, a variable constant voltage source, such as that shown in FIG. 7, is used. The variable constant voltage source maintains the relationship Vr<Vk, but does not increase the magnifying ratio of (1+Rf1/Rf2), and enlarges the ratio of change in the reference voltage Vr even if it increases the Zener voltage Vz.

In particular, in the circuit shown in FIG. 7, the resistors Re12 and Re13 (Re12=Re13) and the transistors TR28 and TR29 form a current mirror circuit, wherein collector currents ic (Vx/Re11) having equal values flow to the transistors TR28 and TR29. The reference voltage Vr will therefore be as expressed by the following equation:

$$\begin{aligned} Vr &= ic\times Rc3+Vz \\ &= (Rc3/Re11)\times Vx+Vz \end{aligned}$$

Accordingly, the fluctuating range of the reference voltage Vr can be made larger by arbitrarily amplifying the correcting voltage Vx by appropriately selecting the respective resistance values of the resistors Rc3 and Re11.

Next, the operation of the circuit shown in FIG. 5 is described with reference to FIG. 8(*a*) through FIG. 8(*d*).

Figures 8A, 8B, 8C, 8D:
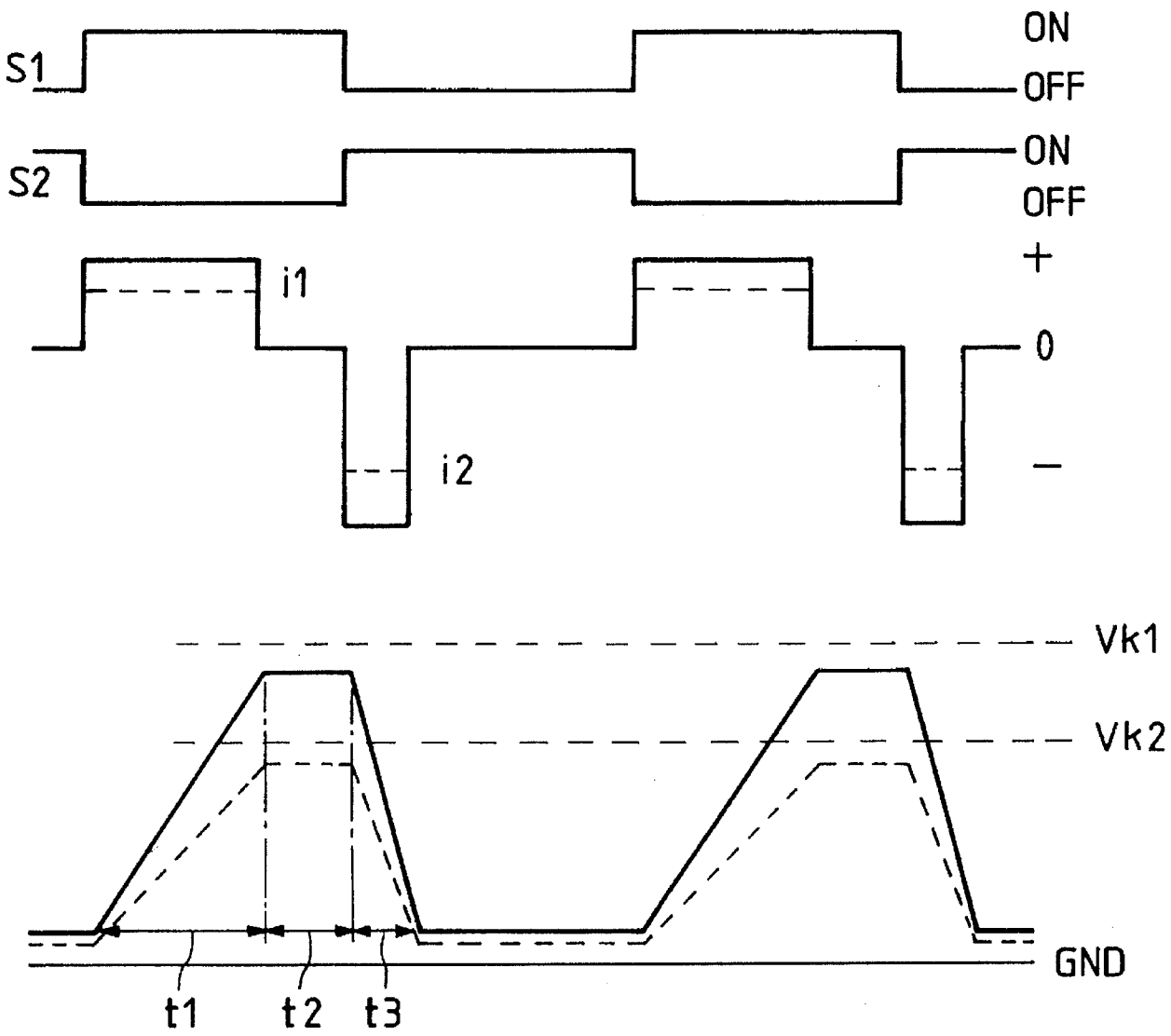
FIGS. 8(*a*) and 8(*b*) illustrate waveforms of control signals generated by the circuit shown in FIG. 5.

FIGS. 8(*a*) and 8(*b*), respectively, illustrate the control signals S1 and S2. These control signals are output by the system controller 60 so that the constant current sources 45 and 46 are operated alternately. In response to these control signals S1 and S2, as shown in FIG. 8(*c*), the constant current source 45 generates a charging current i1 which charges capacitor C, and constant current source 46 generates a discharging current i2 which discharges capacitor C. FIG. 8(*d*) illustrates the wave-form of the voltage Vc at the terminal of the capacitor C, which is charged and discharged, respectively, by charging current il and discharging current i2.

Moreover, a waveform is shown in FIG. 8(*d*) for a case when the output voltage from the variable constant voltage source 40 is reduced from Vk1 to Vk2. In this case, the charging current value i1 and the discharging current value i2 will be smaller in proportion to the decline of the output voltage, and the rising and falling gradients of the voltage Vc at the terminal of the capacitor C being thereby adjusted. However, the charging time $\tau 1$, the peak voltage holding time $\tau 2$, and the discharging time $\tau 3$ will not change. In other words, this circuit is capable of performing stable control over the discharging operation since it does not cause any deviation in the position of the meniscus of the ink at the point in time of jetting the ink even if the output voltage is changed.

Figures 9A, 9B, 9C, 9D:
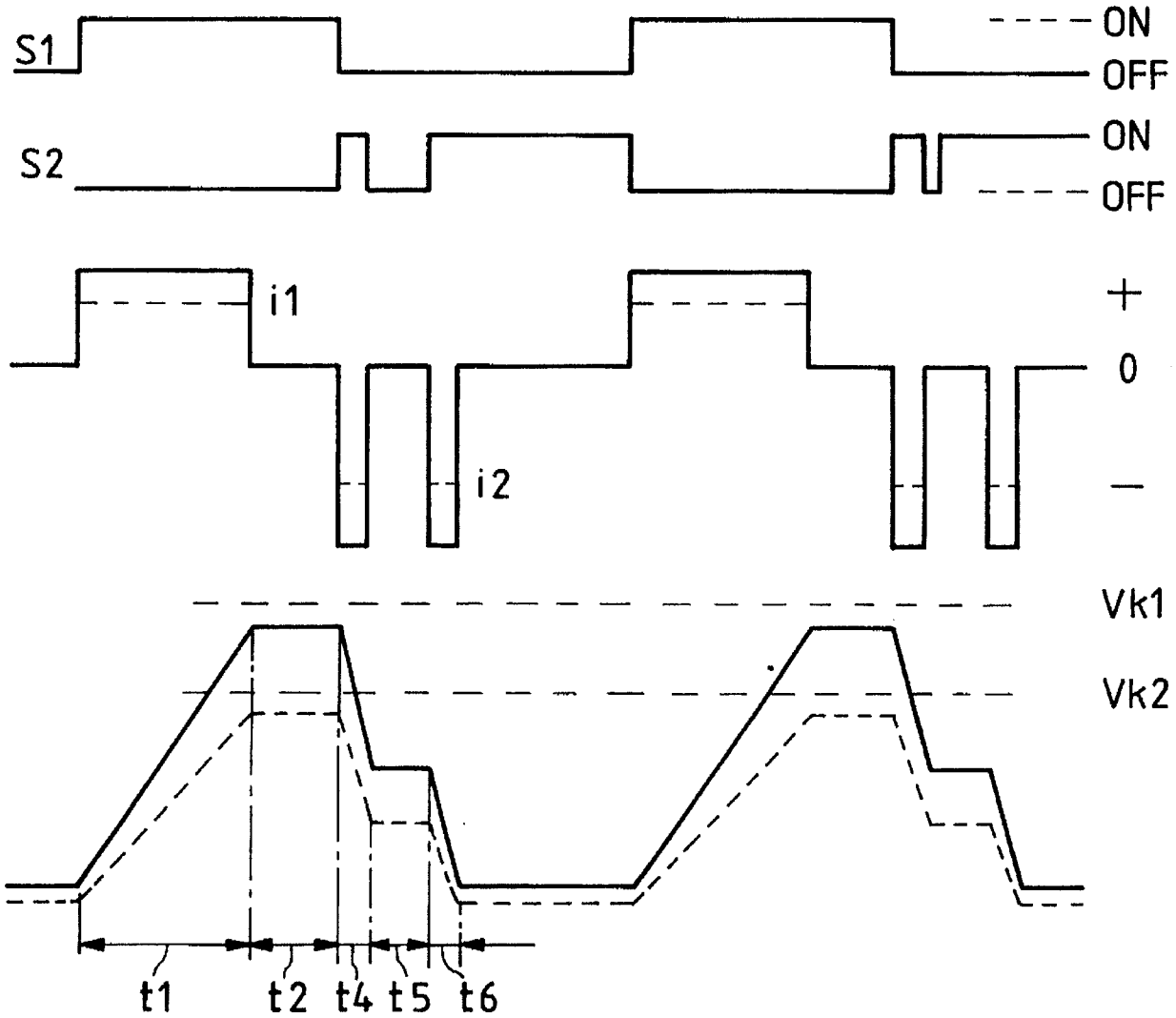
FIGS. 9(*a*) and 9(*b*) are other illustrations of waveforms of the control signals generated by the circuit in FIG. 5.

FIGS. 9(*a*) through 9(*d*) illustrate another driving timing chart, which is an improvement from the driving timing chart shown in FIGS. 8(*a*) through 8(*d*), and which can suppress the residual vibrations of the meniscus to the maximum extent possible after the ink droplets are discharged. As shown, the discharge of the capacitor C is temporarily stopped after the ink is jetted out. Then, the discharge is resumed at the point in time when the meniscus is considerably drawn in, thus canceling the further drawing in of the meniscus.

Even with a driving system like this, it is possible to perform stable control over the jetting of ink droplets because only the rising and falling gradients of the voltage at the terminal of the capacitor C are adjusted as in the timing shown in FIGS. 8(*a*) through 8(*d*). Again, no change is made to the charging time $\tau 1$, the peak voltage holding time $\tau 2$, and the discharging time $\tau 4$ through $\tau 6$.

If the driving system operating as shown in FIGS. 9(*a*) through 9(*d*) is employed, it is be possible to improve the ink jetting period. Further, when the discharge of the capacitor C is stopped halfway in the operation, the waveform of the driving signal can be kept flat because the input impedance of the current amplifier 30 is very high.

In addition, the meniscus will be set in a still sate almost without any vibration if the charging operation is stopped temporarily, with the control signal S1 being turned OFF halfway through the charging operation. If the charging operation is then resumed, with the control signal S1 being turned ON at the point in time when the meniscus returns, it is possible to keep the peak voltage holding time $\tau 2$ a very short period.

Figure 10A:
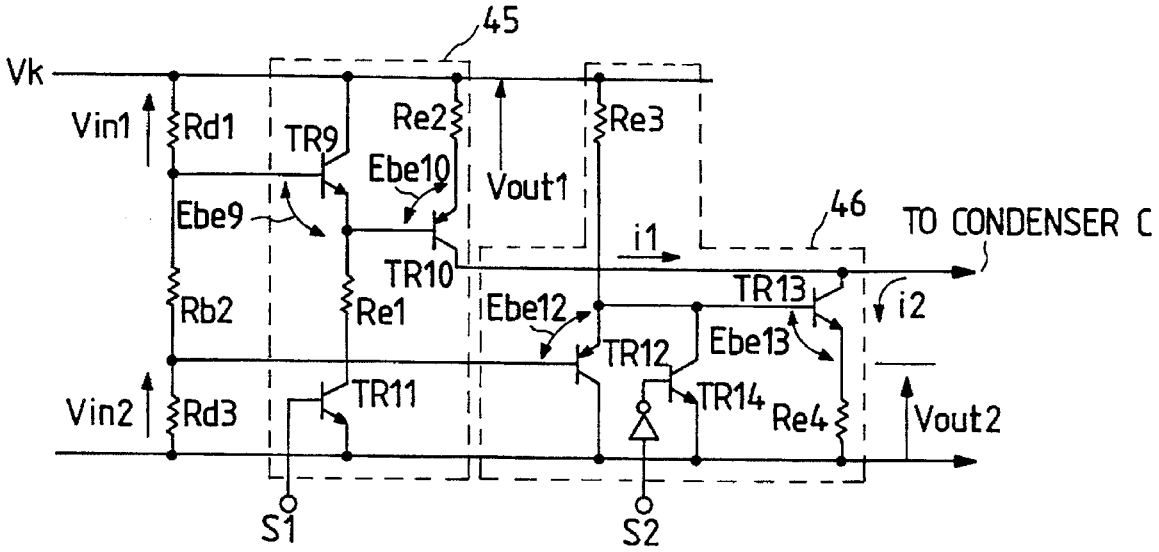
FIGS. 10(*a*) and 10(*b*) are circuit diagrams of an embodiment of the constant current source unit used in the present invention.
Figure 10B:
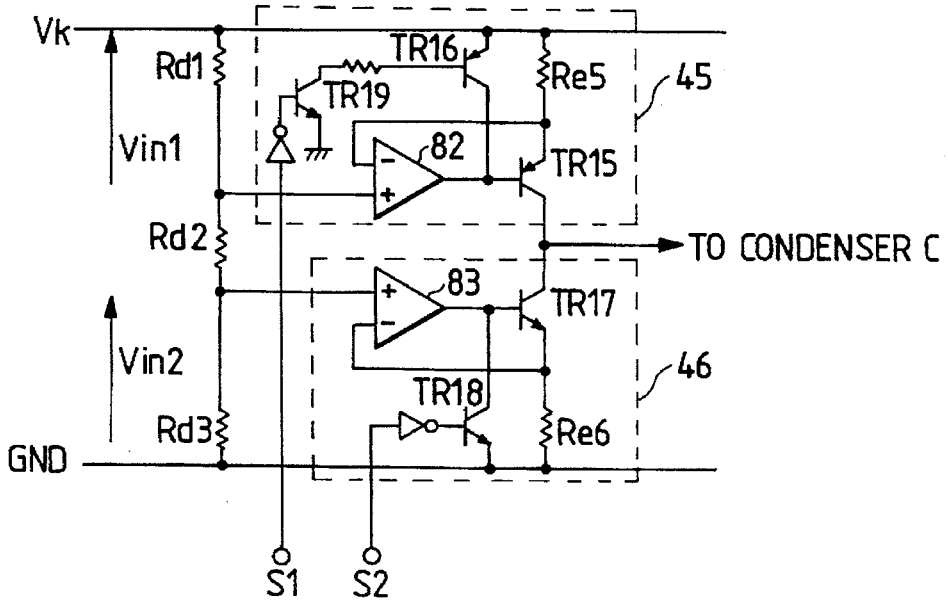

An embodiment of a constant current source used in the present invention will be described. FIG. 10(*a*) illustrates flow type constant current sources 45, and sink type constant voltage source 46, which include mutually complementary transistors in emitter-follower connections.

The constant current source 45 uses voltage Vin1 as its input voltage, and comprises an NPN type transistor TR9 and a PNP type transistor TR10 provided with an emitter resistor Re2. This constant voltage current source 45 also includes a transistor TR11 that is activated by the control signal S1 from the system controller 60.

The constant current source 46 uses voltage Vin2 as its input voltage, and comprises a PNP type transistor TR12 and an NPN type transistor TR13 provided with an emitter resistor Re4. This constant current source 46 further includes transistor TR14 that is activated by the control signal S2 from the system control means 60.

The voltages generated in the resistors Re2 and Re4, respectively, are expressed by the following equations:

$$Vout1=Vin1-Ebe9+Ebe10$$

$$Vout2=Vin2+Ebe12-Ebe13$$

where the saturated voltages between the base and the emitter of each of the transistors TR9, TR10, TR12, and TR13 are expressed by Ebe9, Ebe10, Ebe12, and Ebe13, respectively.

However, since the saturated voltages between the base and emitter of the individual transistors are almost equal in their temperature characteristics, regardless of the polarity, the equations given above can respectively be restated, regardless of the temperature, as follows:

$$Vout1\approx Vin1$$

$$Vout2\approx Vin2$$

Therefore, the flow current i1 from the constant current source 45 is i1=Vin1/Re2, and the sink current i2 from the constant current source 46 is i2=Vin2/Re4. Accordingly, these current can be determined based only on the consistency of the resistance values, without dependence on the temperature.

Since resistors having a tolerance of about 0.5% are available at low cost, this circuit provides a constant current source at low cost and with a high level of performance. In addition, since the constant current source 45 operates at a high degree of accuracy when voltage Vin1 and voltage Vin2 are 0.3 V or higher, it is possible to set the final charging voltage of the capacitor C almost to the output voltage Vk from the variable constant voltage source 40, and to set the final discharging voltage almost to GND.

FIG. 10(*b*) is a diagram illustrating another embodiment of a constant current source, which obtains a constant current by maintaining the voltages generated in the emitter resistors Re5 and Re6 of the transistors TR15 and TR17, respectively, at the voltages Vin1 and Vin2, by using operating amplifiers 82 and 83. However, this circuit becomes unstable in its operation if Vin1 is set approximately equal to the output voltage, or if Vin2 is set approximately equal to GND, when the voltage being supplied to the operating amplifiers 82 and 83 is to be supplied from the output voltage Vk from the variable constant voltage source 40.

In addition, it is possible to form a constant current source by using a current mirror circuit. Although such a constant current source can maintain a very small voltage drop in the constant current source, a pair of transistors having well-balanced characteristics must be used to achieve this.

During actual application of the above circuits, in some circumstances, the peak voltage holding time $\tau 2$ must be made very small. However, such a small peak voltage holding time $\tau 2$ may not be easily obtained due to a dispersion in the accuracy of the constant current source 45 in the circuit shown in FIG. 5.

Accordingly, a circuit which provides an accurate driving voltage Vs will be described with reference to FIG. 11. In this circuit, resistors Re2 or Re5 (shown in FIG. 10(*a*)) for determining the flow current value for the constant current source 45 are replaced with a variable impedance 120, and automatic control is performed on the value of the variable impedance 120 in accordance with a dispersion in the accuracy of the constant current source 45.

In particular, the difference in phase between the point in time when the driving voltage Vs, detected by a peak detector 121, attains the maximum voltage and the reference signal Td, which indicates the control point in time, is detected by a phase detecting circuit 122. The detected difference in phase is converted into an analog voltage signal by a charge pump 123 and an integrating circuit 124, and the analog voltage signal is applied as the base current of the transistor TR31 to adjust the impedance between the collector and the emitter of the transistor TR31.

Figure 11:
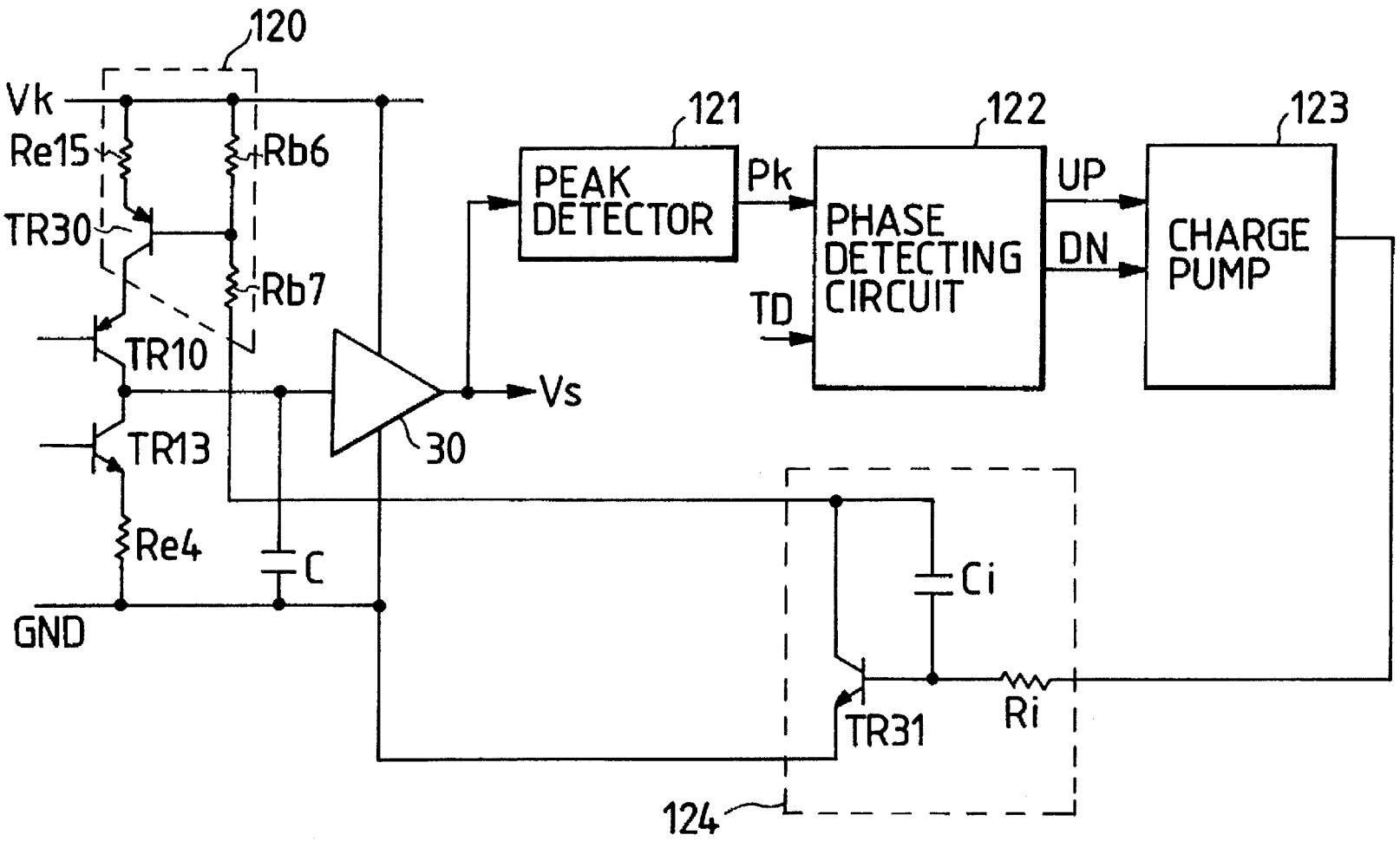
FIG. 11 is a circuit diagram of an embodiment of a driving device similar to the embodiment of the embodiment of the present invention shown in FIG. 5 and realizes a more accurate rise time for the driving voltage.
Figures 12A, 12B, 12C, 12D, 12E, 12F:
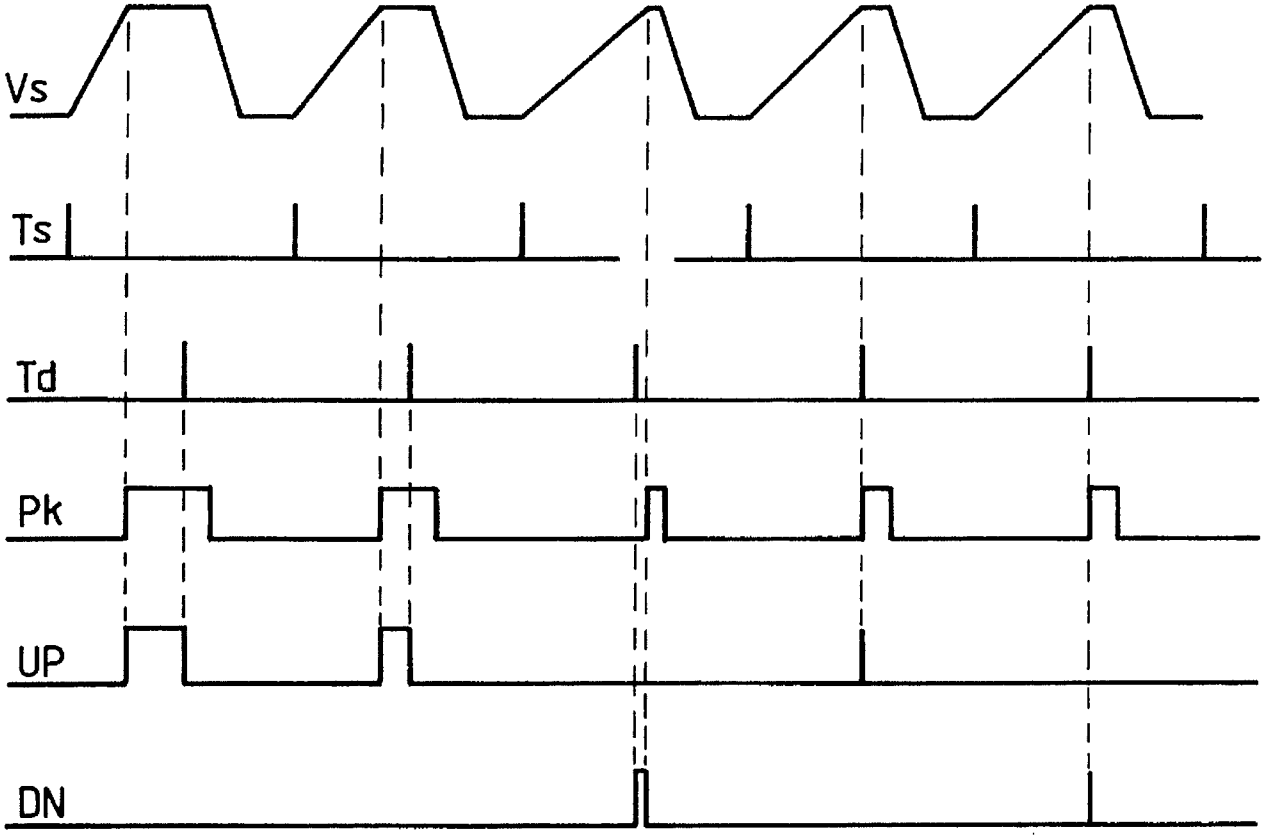
FIG. 12(*a*) is a graph showing the waveform of the driving voltage Vs provided by the circuit shown in FIG. 11.

FIG. 12(*a*) through 12(*d*) are graphs illustrating the operations of the circuit shown in FIG. 11. In particular, FIG. 12(*a*) shows the voltage wave-form of the driving voltage Vs, FIG. 12(*b*) shows the rise-up point in time Ts for the driving voltage Vs, FIG. 12(*c*) shows the reference signal Td output with a lag by the time $\tau 1$ from the occurrence of the rise time Ts, and FIG. 12(*d*) shows the output from the peak detector 121. FIGS. 12(*e*) and 12(*f*) show a phase advance signal (UP) and a delay signal (DN) output from the phase detector 122. In this regard, a similar circuit can be used also for controlling the fall time $\tau 3$ of the driving voltage Vs.

The embodiments described above relate to the operation of an ink jet recording head which, using a d31 type piezoelectric unit, sucks up ink from a reservoir by expanding a pressure chamber in accordance with a voltage applied to a piezoelectric unit, and jets out ink droplets by contracting the pressure chamber by removing the voltage. An embodiment for use with an ink jet recording head using having d33 type piezoelectric units, which operate in reverse to the operation of the d31 type piezoelectric units, is illustrated in FIG. 10.

Figure 13A:
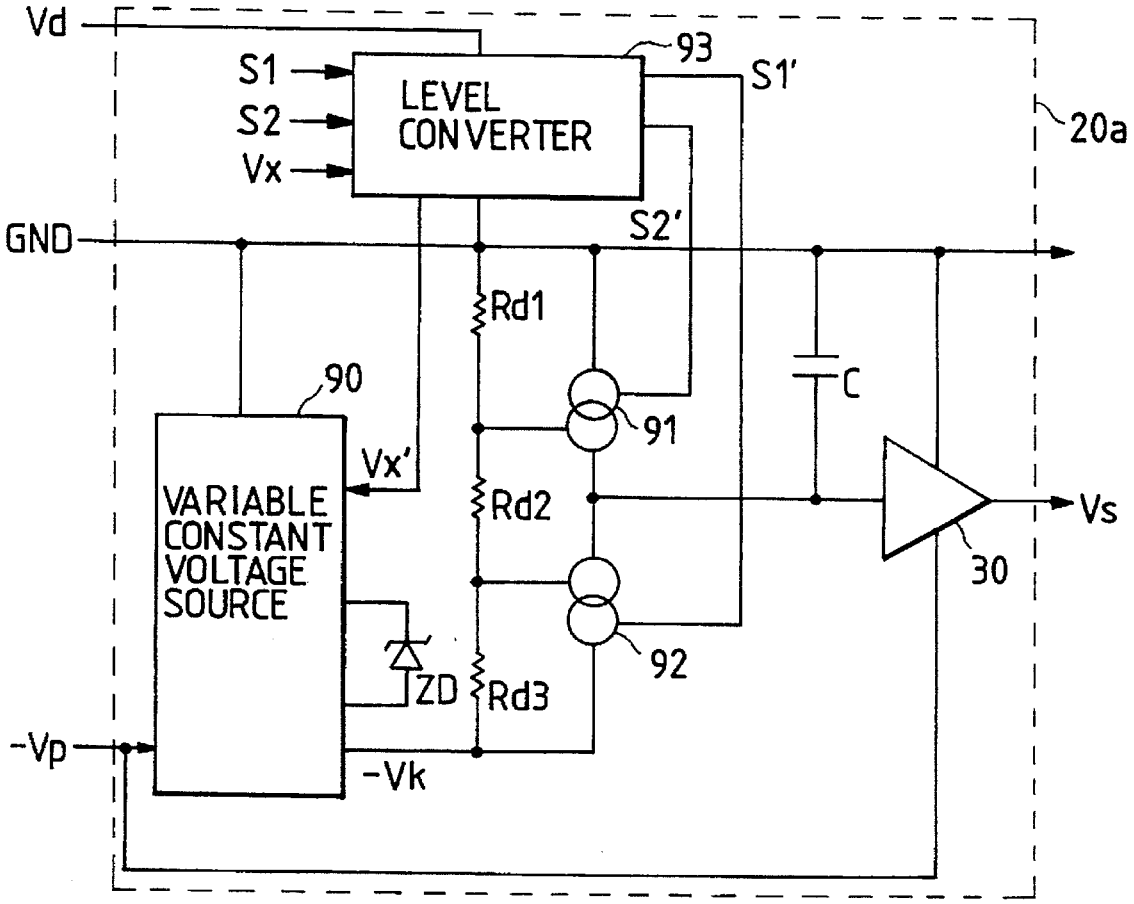
FIG. 13(*a*) is a circuit diagram illustrating an embodiment of a driving voltage generator used in the driving device of the present invention.
Figure 13B:
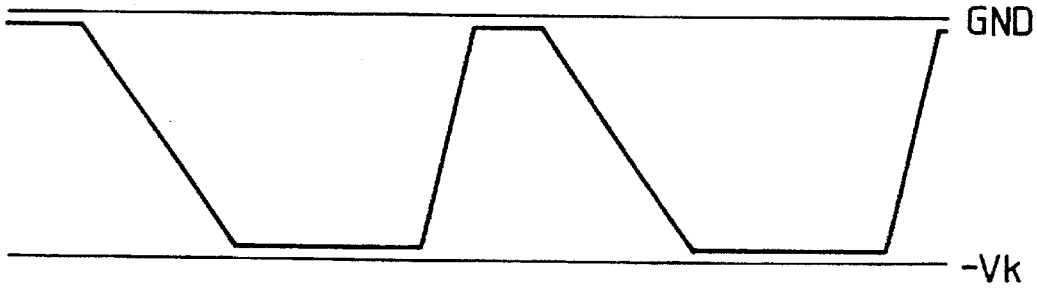

FIG. 13(*a*) is a circuit diagram of a driving voltage generator 20*a*, which is used for an ink jet recording head having d33 type piezoelectric units. A logic power source Vd provides a voltage of 5 V to a level converter 93. This level converter 93 performs a level converting process on the control signals S1 and S2 output from the system controller 60 and the correcting voltage Vx based on the temperature information, provides control signals S1' and S2' to control constant current sources 91 and 92, and provides correcting voltage Vx' to control the voltage (−Vk) output by a variable constant voltage source 90, thereby causing the driving voltage generator 20*a* to generate a driving voltage Vs in a negative voltage shown in FIG. 13(*b*). This driving voltage generator 20*a* also can be employed in the circuit shown in FIG. 5.

This embodiment is advantageous over the first embodiment of the present invention. That is, as described above, the first embodiment of the present invention generates a driving voltage Vs on the basis of a charging voltage and a discharging voltage of capacitor C. However, the capacitor C can have a large change in its capacitance due to the temperature of the environment, or due to a change in comparison with a resistor. In view of this, the second embodiment of the present invention generates a driving voltage Vs without using any capacitor C.

Figure 14:
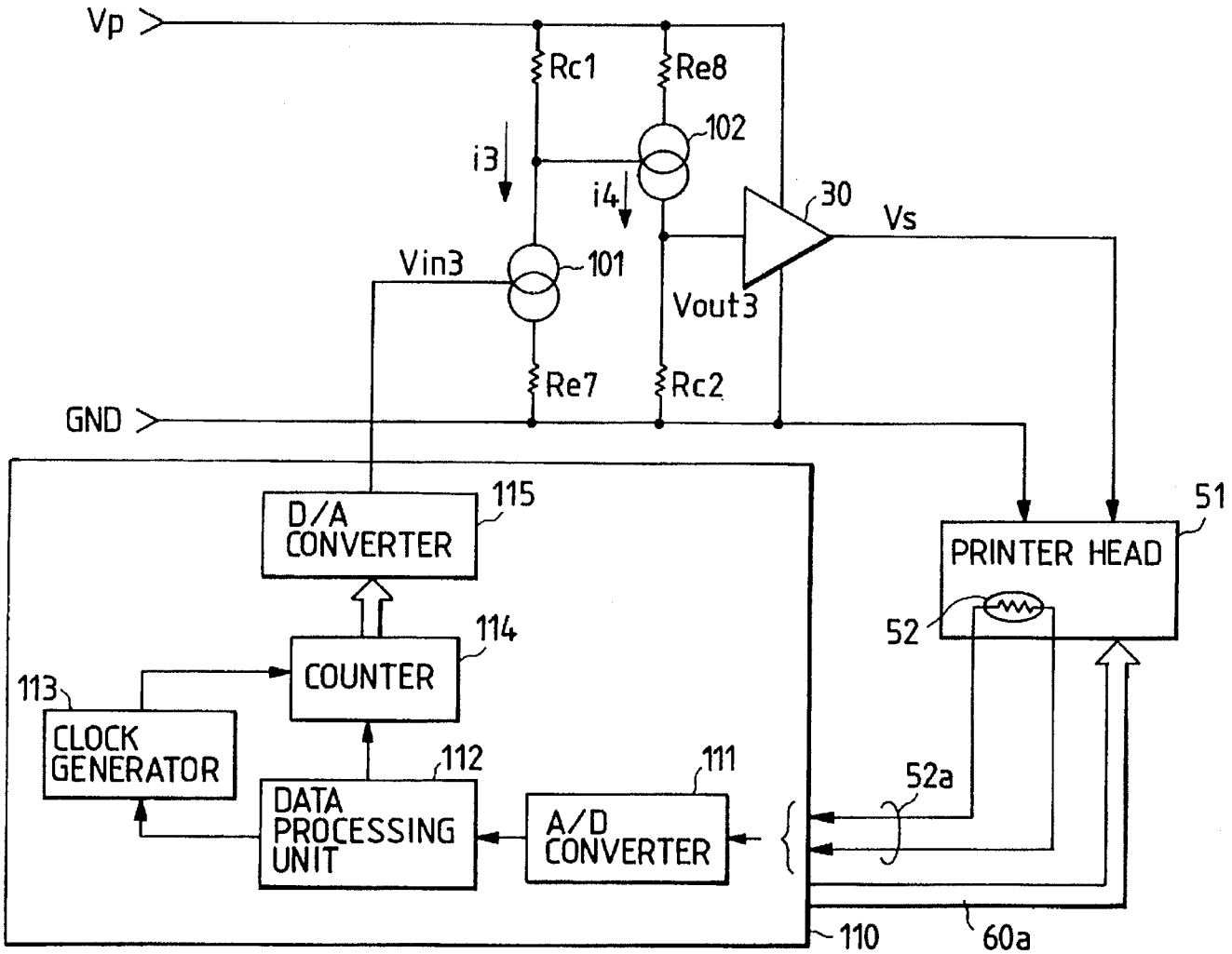
FIG. 14 is a circuit diagram of another embodiment of a driving device of the present invention for use in an ink jet recording head.

FIG. 14 is a diagram illustrating a circuit of the driving device of the second embodiment of the present invention, which employs an analog-digital (A/D) converter 111 in a system controller 110 to convert the temperature information provided by temperature sensing element 52 into digital values. A data processing unit 112 increases the frequency of a clock generator 113 as the temperature becomes lower, depending on whether it is in a charging period or in a discharging period.

Figure 15:
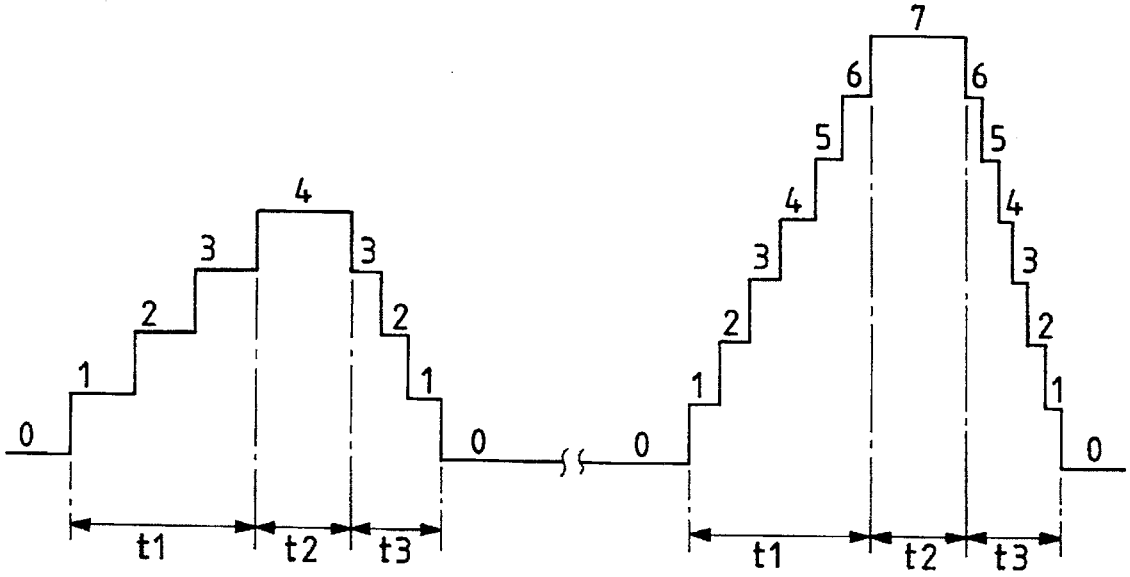
FIG. 15 is a graph showing the waveform of the output voltage from a digital-analog converter of the circuit shown in FIG. 14.

The data processing unit 112 also outputs an adding signal, a counting stop signal, and a subtracting signal in repetition at prescribed time intervals to the counter 114, which counts the clock signals generated from a clock generator 113, to control the counting operation of the counter 114. The digital count output from the counter 114 is converted into an analog value by a digital-analog (D/A) converter 115, which outputs voltage waveforms in stages as shown in FIG. 15. In particular, the right-hand side of FIG. 15 shows the output waveform in a low temperature state in which the viscosity of the ink is increased, and the left-hand side of FIG. 15 shows the output waveform in the normal temperature state.

A constant current source 101 receives the voltage Vin3 from the digital-analog (D/A) converter 115, and in accordance with this voltage, synchronizes the constant current i3 so that i3=Vin3/Re7. Moreover, constant current source 102 inputs a voltage Vh and controls the constant current i4 so that i4=Vh/Re8 with the voltage Vh=Rc1×i3. Therefore, a voltage Vout3=i4×Rc2 is generated at resistor Rc2.

Assuming that Re7=Rc1=Re8=(Re0), then the equation Vout3=Vin3×(Rc2/Re0) is valid, and the voltage Vout3 at an amplification ratio determined by the values of the resistors Rc2 and Re0 is obtained. This voltage Vout3 is further amplified by a power amplifier 30 to become the driving voltage Vs. Hence, in this second embodiment of the present invention, the smoothness of the driving voltage Vs depends on the number of bits of the counter 112, but any number of bits not less than five bits will suffice for practical purposes.

Furthermore, the driving device of the second embodiment of the present invention may be arranged so that if the frequency of the clock generator 113 is set to a fixed value, the output bits of the counter 114 depend on the temperature information and are shifted appropriately and output to the digital-analog converter 115.

An embodiment of the power amplifier 30, which is employed in the driving devices of both embodiments of the present invention, will now be described.

Figure 16A:
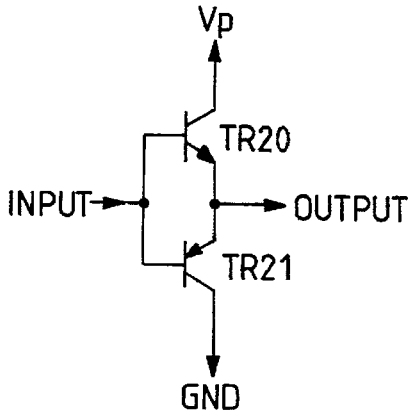
FIGS. 16(*a*) and 16(*b*) are circuit diagrams for a power amplifier circuit.
Figure 16B:
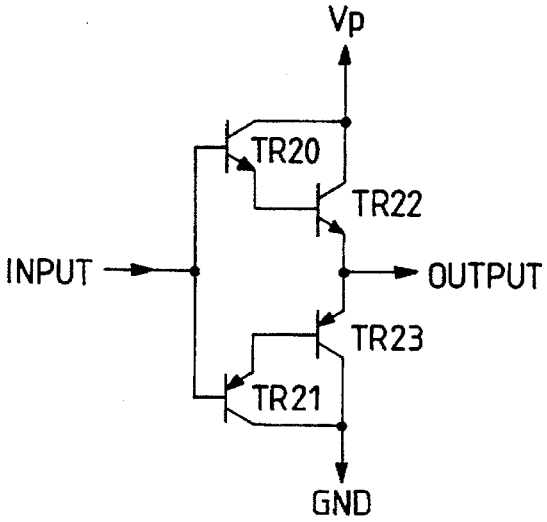
Figure 17A:
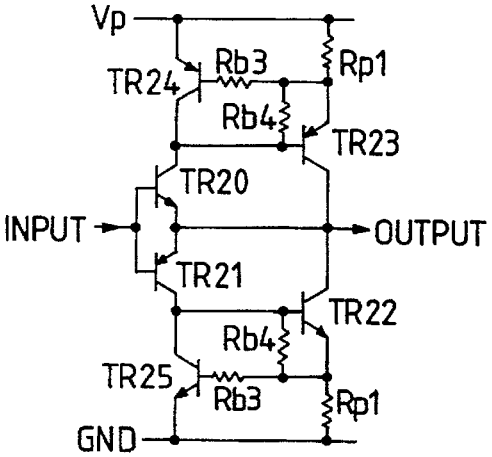
FIGS. 17(*a*) through 17(*d*) are circuit diagrams for embodiments of a power amplifier circuit used in the embodiments of the driving devices of the present invention.
Figure 17B:
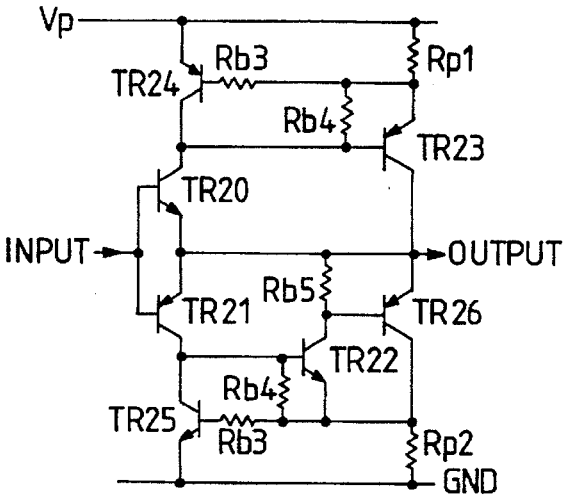
Figure 17C:
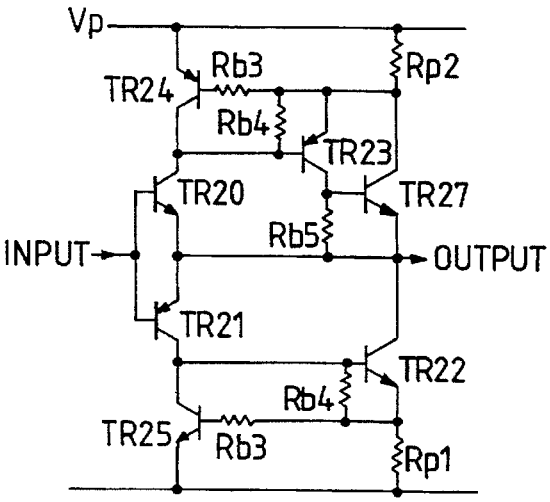
Figure 17D:
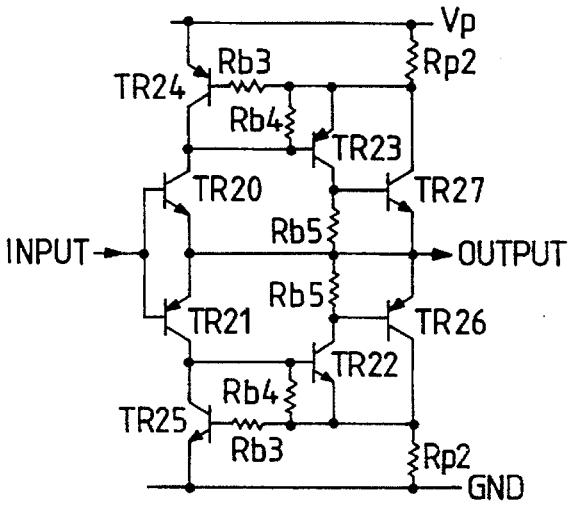

FIGS. 16(*a*) and 16(*b*) illustrate a power amplifier arranged as an emitter-follower comprising mutually complementary transistors coupled in a Darlington connection and, for example, having the same polarity. Although the power amplifying circuits shown in FIGS. 16(*a*) and 16(*b*) can be used if the output has fallen into a nearly short-circuited state, in this case, the base current of transistors TR20 and TR21 or transistors TR22 and TR23 at the final output stage will flow without being limited, so the transistors will break down. Also, with the circuit shown in FIG. 16(*b*), a decrease in the voltage between the input and output can be as great as two times the saturated voltage between the base and the emitter of the transistors.

Therefore, to avoid these problems, the present invention employs a power amplifying circuit as shown in FIG. 17(*a*) through FIG. 17(*d*).

FIG. 17(*a*) illustrates a basic circuit which detects the output current flowing to the final output transistors TR23 and TR22 by using current detecting resistors Rp1 and Rp2. Also, transistors TR24 and TR25 prevents the base current from flowing without being limited. The transistors are also coupled as shown to resistors Rb3 and Rb4.

FIG. 17(*b*), on the other hand, illustrates a circuit for increasing the capacity of the sink current, and includes additional transistors TR26 and TR27. FIG. 17(*c*) shows a circuit for increasing the capacity of the flow current. Finally, FIG. 17(*d*) shows a circuit for increasing both the capacity of the sink current and the capacity of the flow current.

In any of the circuits shown in FIGS. 17(*a*) through 17(*d*), the voltage drop between the input and output is such that one unit portion of the saturated voltage between the base and the emitter of the transistor is sufficient. Further, the resistors Rb4 and Rb5 are used for preventing an open state from forming between the base and the emitter. Whether the circuit shown in FIG. 17(*a*), FIG. 17(*b*), FIG. 17(*c*) or FIG. 17(*d*) is used in the driving circuit of either embodiment depends on the desired maximum output current value, the charging time for the piezoelectric unit, and the length of the discharging time desired.

Moreover, in either embodiment of the driving circuit, the output Vk from the variable constant voltage sources 40 or 90 may be supplied to the power amplifier. However, in these cases, it is necessary to sufficiently increase of the electric power capacity of the variable constant voltage sources 40 and 90. Further, although the transistors employed in the power amplifier and the constant current sources and are illustrated as bipolar transistors, such transistors can be field effect transistors or the like.

As described above, the first embodiment of the present invention provides a driving device having a capacitor that is discharged by a constant current source in which the current value is controlled with a voltage dividing signal output from a variable constant voltage source. The voltage of the capacitor is amplified by a power amplifier to provide a driving voltage Vs for the piezoelectric unit. Hence, the value of the wave height of the driving voltage Vs can be adjusted, while the rise and fall times of the driving voltage Vs are maintained constant simply by controlling the output from the variable constant voltage source in accordance with the temperature in the environment to compensate for viscosity characteristics of the ink. Therefore, it is possible to maintain constant ink jetting characteristics without any influence by the temperature in the environment. Further, by employing in the device a constant current source comprising a pair of mutually complementary transistors, that is, a PNP type transistor and an NPN type transistor, the voltage components between the base and the emitter in these transistors are mutually canceled, so that the constant current source also is not influenced by the temperature.

The second embodiment of the present invention provides a driving device which converts the output from a counter that performs adding, count stopping, and subtracting operations of clock signals at prescribed time intervals, into an analog voltage signal which rises or falls in stages. The analog voltage signal is amplified through a power amplifier to provide a driving voltage Vs for a piezoelectric unit. Hence, a capacitor, whose capacitance may change due to changes in the temperature and a secular change, is not needed. Accordingly, the driving device can generate a more stable driving voltage and can adjust the value of the wave height of the driving voltage Vs, while keeping the rise and fall times of the driving voltage Vs constant, simply by controlling the frequency of the clock signal in accordance with the temperature in the environment to compensate for the viscosity characteristics, etc., of the ink. Thus, the driving device maintains uniform ink jetting characteristics without being influenced by the temperature in the environment.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. An apparatus for generating a driving voltage for driving at least one piezoelectric unit of an ink jet recording head which, when driven, changes the volumetric capacity of an ink chamber of the recording head to jet out ink droplets through a nozzle hole in the recording head, said apparatus comprising:

a constant voltage source for providing an output voltage which varies in accordance with a correcting voltage signal;

a capacitor;

a first constant current source for generating a first constant current in proportion to said output voltage to charge said capacitor so that a voltage of said capacitor increases to a voltage approximately equal to the output voltage within a first constant period of time whose length is unaffected by a variance in a value of the correcting voltage signal;

a second constant current source for providing a second constant current, in proportion to the output voltage, to discharge the capacitor within a second constant period of time whose length is unaffected by the variance in the value of the correcting voltage signal; and a power amplifier for amplifying the voltage of the capacitor to provide said driving voltage, said driving voltage having a constant rise time which corresponds to said first constant period of time and a constant fall time which corresponds to said second constant period of time, said constant rise time and said constant fall time being unaffected by the variance in the value of the correcting voltage signal.

2. An apparatus as claimed in claim 1, further comprising a circuit for adjusting the correcting voltage signal in accordance with a temperature in an environment in which the ink jet recording head is disposed to vary an amplitude of the driving voltage.

3. An apparatus as claimed in claim 1, wherein the first and second constant current sources each comprise:

an input transistor which receives a voltage in proportion to the output voltage;

an output transistor coupled to the input transistor; and a resistor for setting a level of current inserted to the output transistor.

4. An apparatus as claimed in claim 1, further comprising:

a detector which detects a point in time when the driving voltage attains one of a maximum voltage and minimum voltage;

a phase difference detector which detects a deviation in phase between an output from the point in time detector and a reference signal indicating the point in time; and an adjusting circuit which adjusts the first constant current or the second constant current in accordance with an output from the phase difference detector regardless of the output voltage from the constant voltage source; and wherein the driving apparatus automatically adjusts the rise time or the fall time of the driving voltage to a set value.

5. An apparatus as claimed in claim 1, further comprising a controller which provides a first control signal to said first constant current source to control a level of said first constant current to charge said capacitor within said first constant period of time, and a second control signal to said second constant current source to control a level of said second constant current to discharge said capacitor within said second constant period of time.

6. An apparatus for generating a driving voltage for driving at least one piezoelectric unit of an ink jet recording head which, when driven, changes the volumetric capacity of an ink chamber of the recording head to jet out ink droplets through a nozzle hole in the recording head, said apparatus comprising:

a clock which generates a clock signal having a variable frequency;

a counter which counts the clock signal;

a controller which outputs an adding signal, a counting stop signal, and a deducting signal in repetition at prescribed time intervals to the counter;

a digital-analog (D/A) converter for converting the digital output from the counter into an analog voltage; and an amplifier which amplifies the analog voltage to provide the driving voltage, a rise time and a fall time of the driving voltage being constant regardless of the frequency of the clock signal.

7. An apparatus as claimed in claim 6, further comprising a circuit which adjusts the frequency of the clock signal in accordance with a temperature of an environment in which the ink jet recording head is disposed to vary an amplitude of the driving voltage.

8. An apparatus as claimed in any of claims 1 to 7, wherein the power amplifier comprises:

a front stage comprising a first transistor and a second transistor, which are mutually complementary and perform a push-pull operation at the voltage of their base terminals; and an output stage comprising a third transistor circuit, which is substantially complementary with the first transistor, and a fourth transistor circuit, which is substantially complementary with the second transistor, collector current generated by the first transistor being applied as base current to the third transistor circuit and collector current generated by the second transistor being applied as base current to the fourth transistor circuit.

9. An apparatus as claimed in claim 8, further comprising:

a current limiting circuit, which inhibits the base current flowing to the third transistor circuit or the fourth transistor circuit when an output current flowing through the third transistor circuit or the fourth transistor circuit, respectively, is in excess of a predetermined value.

10. A method for generating a driving voltage for driving at least one piezoelectric unit of an ink jet recording head which, when driven, changes the volumetric capacity of an ink chamber of the recording head to jet out ink droplets through a nozzle hole in the recording head, said method comprising the steps of:

providing a variable voltage which varies in accordance with a correcting voltage signal;

generating a first constant current in proportion to the variable voltage;

charging a capacitor by the first constant current to a voltage approximately equal to the variable voltage within a first constant period of time whose length is unaffected by a variance in a value of the correcting voltage signal;

generating a second constant current in proportion to the variable voltage to discharge the capacitor in accordance therewith within a second constant period of time whose length is unaffected by the variance in the value of the correcting voltage signal; and amplifying the voltage of the capacitor to provide said driving voltage, said driving voltage having a constant rise time which corresponds to said first constant period of time and a constant fall time which corresponds to said second constant period of time, said constant rise time and said constant fall time being unaffected by the variance in the value of the correcting voltage signal.

11. A method as claimed in claim 10, further comprising the step of adjusting the correcting voltage signal in accordance with a temperature in an environment in which the ink jet recording head is disposed to vary an amplitude of the driving voltage.

12. A method as claimed in claim 10, further comprising the step of:

detecting a point in time when the driving voltage attains one of a maximum voltage and minimum voltage and outputting a detection signal;

detecting a deviation in phase between the detection signal and a reference signal indicating the point in time and outputting a deviation signal; and adjusting one of the first constant current and the second constant current in accordance with the deviation signal regardless of variable voltage so that one of the rise time and the fall time of the driving voltage are automatically adjusted to a set value.

13. A method a claimed in claim 10, further comprising a step of controlling said first constant current source to control a level of said first constant current to charge said capacitor within said first constant period of time, and controlling said second constant current source to control a level of said second constant current to discharge said capacitor within said second constant period of time.

14. A method for generating a driving voltage for driving at least one piezoelectric unit of an ink jet recording head which, when driven, changes the volumetric capacity of an ink chamber of the recording head to jet out ink droplets through a nozzle hole in the recording head, said method comprising the steps of:

generating a digital clock signal having a variable frequency;

counting the clock signal;

outputting an adding signal, a counting stop signal, and a deducting signal in repetition at prescribed time intervals to the counter;

converting the digital clock signal into an analog signal; and amplifying the analog signal to provide the driving voltage, a rise time and a fall time of the driving voltage being constant regardless of the frequency of the clock signal.

15. A method as claimed in claim 14, further comprising the step of adjusting the frequency of the clock signal in accordance with a temperature of an environment in which the ink jet recording head is disposed to vary an amplitude of the driving voltage.

* * * * *